US009815642B2

(12) United States Patent
Matsui et al.

(10) Patent No.: US 9,815,642 B2
(45) Date of Patent: Nov. 14, 2017

(54) SHEET MATERIAL FEEDING DEVICE AND IMAGE FORMING APPARATUS

(71) Applicant: Konica Minolta, Inc., Chiyoda-ku, Tokyo (JP)

(72) Inventors: Naoki Matsui, Toyohashi (JP); Masanobu Tomiyasu, Toyohashi (JP); Yasuaki Tomoda, Toyohashi (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 15/452,833

(22) Filed: Mar. 8, 2017

(65) Prior Publication Data

US 2017/0275114 A1 Sep. 28, 2017

(30) Foreign Application Priority Data

Mar. 22, 2016 (JP) ..... 2016-056489

(51) Int. Cl.
*B65H 1/22* (2006.01)
*B65H 1/26* (2006.01)
(Continued)

(52) U.S. Cl.
CPC ..... *B65H 1/266* (2013.01); *B65H 1/08* (2013.01); *B65H 3/06* (2013.01); *B65H 9/04* (2013.01);
(Continued)

(58) Field of Classification Search
CPC ... B65H 1/08; B65H 1/12; B65H 1/14; B65H 1/266; B65H 9/04; B65H 2405/112;
(Continued)

(56) References Cited

U.S. PATENT DOCUMENTS 7,648,135 B2 * 1/2010 Matsushima ..... B65H 1/266 271/145
2003/0116907 A1 * 6/2003 Pearce ..... B65H 1/04 271/145
(Continued)

FOREIGN PATENT DOCUMENTS

JP 2004-142892 A 5/2004
JP 2009-132469 6/2009
(Continued)

OTHER PUBLICATIONS

Extended European Search Report issued in corresponding European Patent Application No. 17160549.6-1731, dated Jul. 28, 2017 (7 pages).

*Primary Examiner* — Prasad V Gokhale
(74) *Attorney, Agent, or Firm* — Buchanan Ingersoll & Rooney PC

(57) ABSTRACT

A sheet material feeding device includes: a housing; a cassette configured to internally house a sheet material, and capable of being pulled out of the housing and housed into the housing; a rear-end regulating member provided inside the cassette and configured to regulate a position of an upstream end of the sheet material in a sheet material feeding direction; a rear-end displacing member supported by the rear-end regulating member and configured to swing along the sheet material feeding direction; a sliding member provided for the cassette, having an engagement part to be engaged with the rear-end displacing member, and configured to slide toward a downstream side in the sheet material feeding direction to displace the rear-end displacing member toward the downstream side in the sheet material feeding direction; and a first energizing member configured to energize the sliding member toward an upstream side in the sheet material feeding direction.

14 Claims, 10 Drawing Sheets

(51) Int. Cl.
*B65H 9/04* (2006.01)
*B65H 1/08* (2006.01)
*B65H 3/06* (2006.01)

(52) U.S. Cl.
CPC ..... *B65H 2405/1117* (2013.01); *B65H 2405/1122* (2013.01); *B65H 2405/1124* (2013.01); *B65H 2511/11* (2013.01); *B65H 2801/06* (2013.01)

(58) Field of Classification Search
CPC .... B65H 2405/1122; B65H 2405/1124; B65H 2405/1117; B65H 2405/12; B65H 2405/121; B65H 2405/31; B65H 2405/32; B65H 2511/00; B65H 2511/10; B65H 2511/11
See application file for complete search history.

(56) References Cited

U.S. PATENT DOCUMENTS

2010/0172685 A1* 7/2010 Kim ..... B41J 13/103 400/613
2016/0214809 A1* 7/2016 Waragai ..... B65H 1/12

FOREIGN PATENT DOCUMENTS

JP 2011-148634 8/2011
JP 2014065607 A * 4/2014 ..... B65H 3/00

* cited by examiner

SHEET MATERIAL FEEDING DEVICE AND IMAGE FORMING APPARATUS

The entire disclosure of Japanese Patent Application No. 2016-056489 filed on Mar. 22, 2016 including description, claims, drawings, and abstract are incorporated herein by reference in its entirety.

BACKGROUND

Technological Field

The present invention relates to a sheet material feeding device and an image forming apparatus including the same.

Description of the Related art

An image forming apparatus such as a copier, a printer, or a facsimile machine includes a sheet material feeding device for feeding a sheet material such as paper. The sheet material feeding device includes a rear-end regulating member for regulating the position of an upstream end (rear end) of the sheet material in the feeding direction inside a cassette for housing the sheet material. As the amount of sheet materials in the cassette decreases along with the feeding, the posture of the sheet materials changes. To enable the stable feeding even under such a circumstance, a rear-end displacing member may be provided additionally. The rear-end displacing member is brought into contact with the sheet material while pressing the sheet material from the upstream side to the downstream side in the feeding direction.

In regard to such a sheet material feeding device, there are concerns that the rear-end displacing member interrupts the supply of sheet materials to the cassette and the supplied sheet material is bent if the amount of supplied sheet material is small. According to the technique suggested in order to solve such problems, the rear-end displacing member is displaced toward the upstream side in the feeding direction when the cassette is pulled out of a housing. One example of the conventional technique of the sheet material feeding device is disclosed in JP 2004-142892 A.

The sheet material feeding device according to JP 2004-142892 A includes: the end fence (rear-end regulating member); the pressing element (rear-end displacing member) that protrudes from the end fence toward the downstream side in the feeding direction; the energizing member that energizes the pressing element toward the downstream side in the feeding direction; and the energizing force switching unit for switching whether to apply the energizing force with the energizing member in accordance with the pulling out. In this sheet material feeding device, the energizing force of the energizing member to energize the pressing element is exerted by pushing the cassette into a predetermined position and the energizing force of the energizing member to energize the pressing element is not exerted by pulling out the cassette from the predetermined position.

Since the end fence (rear-end regulating member) of the sheet material feeding device according to JP 2004-142892 A incorporates the energizing member for the pressing element (rear-end displacing member) and the energizing force switching unit, the size increase of the end fence has been a problem. In addition, this results in the size increase of the cassette and the sheet material feeding device, and also results in the size increase of the image forming apparatus.

SUMMARY

The present invention has been made in view of the above, and an object of the present invention is to provide a sheet material feeding device and an image forming apparatus with the reduced size, which can achieve the stable feeding even if the posture of the sheet material has changed as the amount of sheet material in the cassette decreases along with the feeding.

To achieve the abovementioned object, according to an aspect, a sheet material feeding device reflecting one aspect of the present invention comprises: a housing; a cassette configured to internally house a sheet material, and capable of being pulled out of the housing and housed into the housing; a rear-end regulating member provided inside the cassette and configured to regulate a position of an upstream end of the sheet material in a sheet material feeding direction; a rear-end displacing member supported by the rear-end regulating member and configured to swing along the sheet material feeding direction; a sliding member provided for the cassette, having an engagement part to be engaged with the rear-end displacing member, and configured to slide toward a downstream side in the sheet material feeding direction to displace the rear-end displacing member toward the downstream side in the sheet material feeding direction as the cassette is housed in the housing; and a first energizing member configured to energize the sliding member toward an upstream side in the sheet material feeding direction.

According to this structure, as the cassette is housed into the housing, the sliding member provided for the cassette slides to the downstream side in the sheet material feeding direction to displace the rear-end displacing member to the downstream side in the sheet material feeding direction. The sliding member is energized by the first energizing member to the upstream side in the sheet material feeding direction; therefore, while the cassette is not housed in the housing, i.e., as the cassette is pulled out of the housing, the displacement of the rear-end displacing member toward the downstream side in the sheet material feeding direction is canceled. Outside the rear-end regulating member, the first energizing member and the sliding member for displacing the rear-end displacing member in the sheet material feeding direction and switching whether to displace the rear-end displacing member in the sheet material feeding direction are provided. That is, the rear-end regulating member is formed to be relatively compact.

Furthermore, the sheet material feeding device preferably further comprises: a first lever member connected to the sliding member and configured to be brought into contact with the housing to cause the sliding member to slide toward the downstream side in the sheet material feeding direction as the cassette is housed in the housing; and a second energizing member provided between the sliding member and the first lever member and configured to exert an elastic force in the sheet material feeding direction.

Furthermore, in the sheet material feeding device, the engagement part of the sliding member is preferably one of a plurality of engagement parts to be engaged with the rear-end displacing member, the engagement parts being arranged side by side in the sheet material feeding direction, and the rear-end regulating member preferably includes a selecting member that selects whether to engage or disengage the rear-end displacing member relative to the engagement part.

Furthermore, in the sheet material feeding device, the sliding member is preferably disposed at an outer bottom part of the cassette.

Furthermore, the sheet material feeding device preferably further comprises: a lift-up plate which is disposed on an inner bottom surface of the cassette and on which the sheet material is placed; a lift-up plate displacing mechanism configured to change a posture of the lift-up plate; and a second lever member that is connected to the lift-up plate displacing mechanism and as the cassette is housed into the housing, is brought into contact with the housing and causes the lift-up plate displacing mechanism to operate to change a posture so as to lift up the lift-up plate.

Furthermore, in the sheet material feeding device, before the lifting of the lift-up plate is completed, the sliding member preferably displaces the rear-end displacing member toward the downstream side in the sheet material feeding direction.

Furthermore, the sheet material feeding device preferably further comprises a rear-end contact member that is disposed between the rear-end displacing member and an upstream end of the sheet material in the sheet material feeding direction and that is displaced in the sheet material feeding direction as the rear-end displacing member is displaced in the sheet material feeding direction.

Furthermore, in the sheet material feeding device, the engagement part of the sliding member is preferably one of a plurality of engagement parts to be engaged with the rear-end displacing member, the engagement parts being arranged side by side in the sheet material feeding direction, and the rear-end regulating member preferably includes a selecting member that selects whether to engage or disengage the rear-end displacing member relative to the engagement part.

To achieve the abovementioned object, according to an aspect, an image forming apparatus reflecting one aspect of the present invention comprises the sheet material feeding device described above.

Furthermore, the image forming apparatus preferably further comprises an image forming unit configured to form an image on a sheet material supplied from the sheet material feeding device.

To achieve the abovementioned object, according to an aspect, a sheet material feeding device reflecting one aspect of the present invention comprises: a housing; a cassette configured to internally house a sheet material, and capable of being pulled out of the housing and housed into the housing; a rear-end regulating member provided inside the cassette and configured to regulate a position of an upstream end of the sheet material in a sheet material feeding direction; a rear-end displacing member supported by the rear-end regulating member and configured to swing along the sheet material feeding direction; a sliding member disposed at an outer bottom part of the cassette, having an engagement part to be engaged with the rear-end displacing member, and configured to slide toward a downstream side in the sheet material feeding direction to displace the rear-end displacing member toward the downstream side in the sheet material feeding direction as the cassette is housed in the housing; and a first energizing member configured to energize the sliding member to an upstream side in the sheet material feeding direction.

Furthermore, the sheet material feeding device preferably further comprises: a first lever member connected to the sliding member and configured to be brought into contact with the housing to cause the sliding member to slide toward the downstream side in the sheet material feeding direction as the cassette is housed in the housing; and a second energizing member provided between the sliding member and the first lever member and configured to exert an elastic force in the sheet material feeding direction.

Furthermore, in the sheet material feeding device, the engagement part of the sliding member is preferably one of a plurality of engagement parts to be engaged with the rear-end displacing member, the engagement parts being arranged side by side in the sheet material feeding direction, and the rear-end regulating member preferably includes a selecting member that selects whether to engage or disengage the rear-end displacing member relative to the engagement part.

Furthermore, the sheet material feeding device preferably further comprises: a lift-up plate which is disposed at an inner bottom surface of the cassette and on which the sheet material is loaded; a lift-up plate displacing mechanism configured to change a posture of the lift-up plate; and a second lever member that is connected to the lift-up plate displacing mechanism and as the cassette is housed into the housing, is brought into contact with the housing and causes the lift-up plate displacing mechanism to operate to change a posture so as to lift up the lift-up plate.

Furthermore, in the sheet material feeding device, before the lifting of the lift-up plate is completed, the sliding member preferably displaces the rear-end displacing member toward the downstream side in the sheet material feeding direction.

Furthermore, the sheet material feeding device preferably further comprises a rear-end contact member that is disposed between the rear-end displacing member and an upstream end of the sheet material in the sheet material feeding direction and that is displaced in the sheet material feeding direction as the rear-end displacing member is displaced in the sheet material feeding direction.

BRIEF DESCRIPTION OF THE DRAWING

The advantages and features provided by one or more embodiments of the invention will become more fully understood from the detailed description given hereinbelow and the appended drawings which are given by way of illustration only, and thus are not intended as a definition of the limits of the present invention, and wherein.

DETAILED DESCRIPTION OF EMBODIMENTS

Hereinafter, an embodiment of the present invention will be described with reference to the drawings. However, the scope of the invention is not limited to the illustrated examples.

Figure 1:
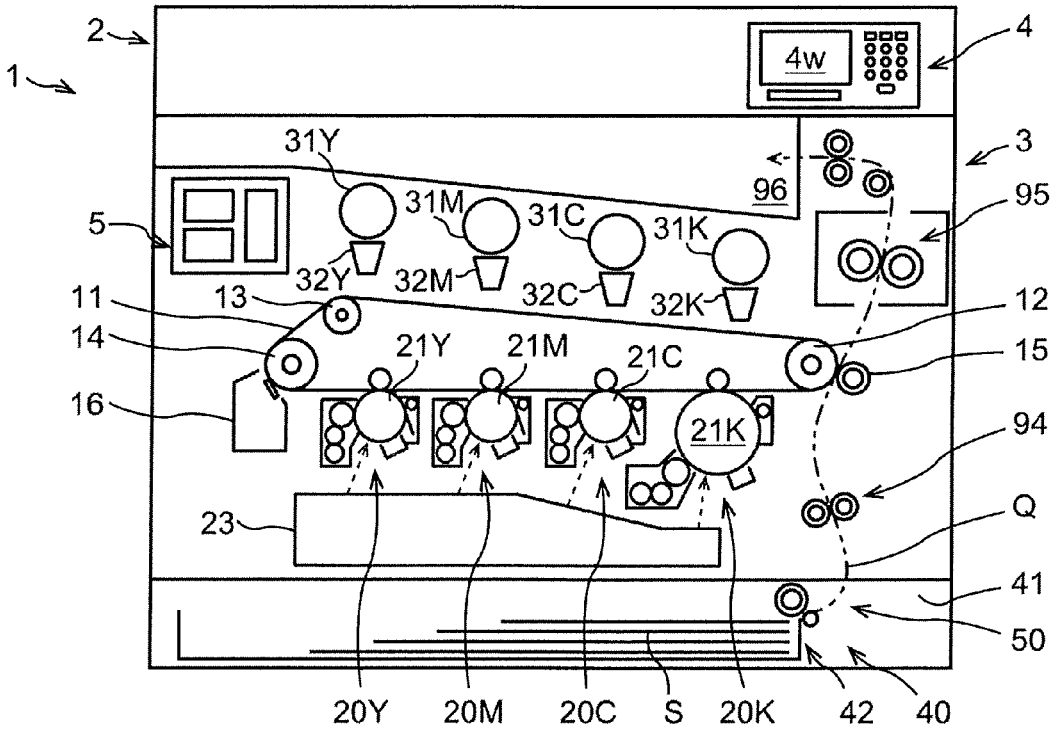
FIG. 1 is a partial vertical sectional front view of an image forming apparatus according to an embodiment of the present invention.

First, the outline of a structure of an image forming apparatus according to an embodiment of the present invention is described with reference to FIG. 1 and at the same time, the image output operation is described. FIG. 1 illustrates an example of a partial vertical sectional front view of the image forming apparatus. In the drawing, a two-dot chain line with an arrow indicates the sheet material transport path and the transport direction.

An image forming apparatus 1 is a so-called tandem type color copier and includes an image reading unit 2 for reading an image of a document, a printing unit 3 for printing the read image on a sheet material such as paper, an operation unit 4 for inputting a print condition or displaying an operation status, and a main control unit 5 as illustrated in FIG. 1.

The image reading unit 2 is a known one that reads the image of the document placed on an upper surface of an unshown platen glass by moving an unshown scanner. The image of the document is decomposed into three colors of red (R), green (G), and blue (B), and is converted into electric signals with an unshown charge coupled device (CCD) image sensor. Thus, the image reading unit 2 obtains image data for each of red (R), green (G), and blue (B) colors.

The image data for each color obtained by the image reading unit 2 are variously processed in the main control unit 5, and are converted into image data for each reproducing color of yellow (Y), magenta (M), cyan (C), and black (K), and then stored in an unshown memory of the main control unit 5. The image data for each reproducing color stored in the memory are processed for the displacement correction and then, the image data are read out for each scan line in synchronization with the transport of the sheet material for optical scanning with respect to a photosensitive drum 21 as an image carrier.

The printing unit 3 forms an image by an electrophotography method, and transfers the image to the sheet material. The printing unit 3 includes an intermediate transfer belt 11 corresponding to an intermediate transfer body with an endless belt shape. The intermediate transfer belt 11 is wound around a driving roller 12, a tension roller 13, and a driven roller 14. To the intermediate transfer belt 11, the tension is applied because the tension roller 13 is energized upward in FIG. 1 by a spring, which is not shown. The intermediate transfer belt 11 is rotated counterclockwise in FIG. 1 by the driving roller 12.

The driving roller 12 is provided opposite to a secondary transfer roller 15 with the intermediate transfer belt 11 interposed therebetween, and is in pressure contact with the secondary transfer roller 15. An intermediate transfer cleaning unit 16 is provided opposite to the driven roller 14 with the intermediate transfer belt 11 interposed therebetween, and in the place of the driven roller 14, the intermediate transfer cleaning unit 16 is in contact with an outer peripheral surface of the intermediate transfer belt 11. After a toner image formed on the outer peripheral surface of the intermediate transfer belt 11 is transferred to a sheet material S, the intermediate transfer cleaning unit 16 cleans by removing the attached substance such as the toner remaining on the outer peripheral surface of the intermediate transfer belt 11.

Below the intermediate transfer belt 11, image forming units 20Y, 20M, 20C, and 20K for the respective reproducing colors of yellow (Y), magenta (M), cyan (C), and black (K) are provided. In this description, the image forming units may be collectively referred to as, for example, "image forming units 20" by omitting the identification letters of "Y", "M", "C", and "K" unless the particular limitation is necessary. The four image forming units 20 are disposed in a line from the upstream side to the downstream side in the rotating direction along the rotating direction of the intermediate transfer belt 11. The four image forming units 20 have the same structure and have a charging unit, an exposing unit, a developing unit, a drum cleaning unit, and a primary transfer roller around the photosensitive drum 21 that rotates clockwise in FIG. 1.

Below the image forming units 20, a scanning optical device 23 corresponding to the exposing device is disposed. One scanning optical device 23 is used with respect to the four image forming units 20, and includes four light sources such as semiconductor lasers, which are not shown, in accordance with the four photosensitive drums 21. The scanning optical device 23 modulates the four semiconductor lasers in accordance with the image gradation data of each reproducing color, and emits laser beams for the respective reproducing colors to the four photosensitive drums 21.

Above the intermediate transfer belt 11, toner bottles 31 and toner hoppers 32 for the four image forming units 20 for the reproducing colors are provided. The developing unit and the toner hopper 32 are provided with a residual amount detection unit, which is not shown, for detecting the remaining amount of toner inside. Between the developing unit and the toner hopper 32 and between the toner hopper 32 and the toner bottle 31, a toner supply device, which is not shown, is provided. When the residual amount detection unit has detected the decrease in residual amount of toner inside the developing unit, the supply device is driven to supply the toner from the toner hopper 32 to the developing unit. In addition, when the residual amount detection unit has detected the decrease in residual amount of toner inside the toner hopper 32, the supply device is driven to supply the toner from the toner bottle 31 to the toner hopper 32. The toner bottle 31 is detachably attached to the apparatus main body, and can be replaced for a new one when necessary.

Below the scanning optical device 23, a sheet material feeding device 40 is provided. In the sheet material feeding device 40, a plurality of sheet materials S such as paper is loaded and housed. Pieces of the sheet materials S housed in the sheet material feeding device 40 are sequentially sent one by one to the sheet material transport path Q in the order from the uppermost piece of sheet material S by a feeding unit 50. The sheet material S sent from the sheet material feeding device 40 to the sheet material transport path Q reaches the place of a resist roller pair 94. The resist roller pair 94 corrects the oblique feeding (performs skew correction) of the sheet materials S and at the same time, feeds the sheet material S toward a contact portion (a secondary transfer nip portion) between the intermediate transfer belt 11 and the secondary transfer roller 15 in synchronization with the rotation of the intermediate transfer belt 11.

In the image forming unit 20, an electrostatic latent image is formed on a surface of the photosensitive drum 21 with a laser beam emitted from the scanning optical device 23, and the electrostatic latent image is visualized as a toner image by the developing unit. The toner image formed on the surface of the photosensitive drum 21 is subjected to the primary transfer to an outer peripheral surface of the intermediate transfer belt 11 in the place where the photosensitive drum 21 is provided opposite to the primary transfer roller with the intermediate transfer belt 11 interposed therebetween. By transferring the toner images of the respective image forming units 20 sequentially to the intermediate transfer belt 11 at predetermined timings as the intermediate transfer belt 11 is rotated, the color toner image in which the four-color toner images of yellow, magenta, cyan, and black are overlapped is formed on the outer peripheral surface of the intermediate transfer belt 11.

The color toner image which has been formed by the primary transfer on the outer peripheral surface of the intermediate transfer belt 11 is transferred to the sheet material S sent in synchronization by the resist roller pair 94 in the secondary transfer nip portion where the intermediate transfer belt 11 and the secondary transfer roller 15 are in contact with each other.

A fixing unit 95 is provided above the secondary transfer nip portion. The sheet material S on which the unfixed toner image is transferred in the secondary transfer nip portion is sent to the fixing unit 95 where the sheet material S is held between a heating roller and a pressurizing roller, so that the toner image is heated and pressurized. Thus, the toner image is fixed on the sheet material S. The sheet material S having passed the fixing unit 95 is discharged to a sheet material discharging unit 96 provided above the intermediate transfer belt 11.

An operation unit 4 is provided on a front surface side of the image reading unit 2. The operation unit 4 accepts the input of the settings of, for example, the printing conditions such as the kind and the size of the sheet material S used by the user in the printing and whether the image is magnified or reduced and the printing is the double-sided one or not, and the input of the settings of the fax number, the sender's name, and the like in the faxing. The operation unit 4 also displays the state of the device, the precautions, the error message, and the like on a display unit 4*w*, and serves as a notification unit that provides the user with such notifications.

To control the entire operation, the image forming apparatus 1 includes the main control unit 5 including a CPU, an image processing unit, and other electronic components which are not shown. The main control unit 5 uses the CPU corresponding to a central processing unit, and the image processing unit to control the elements such as the image reading unit 2, the printing unit 3, and the like in accordance with the program and data stored and input in the memory. Thus, the main control unit 5 achieves a series of image forming operations and printing operations.

Figure 2:
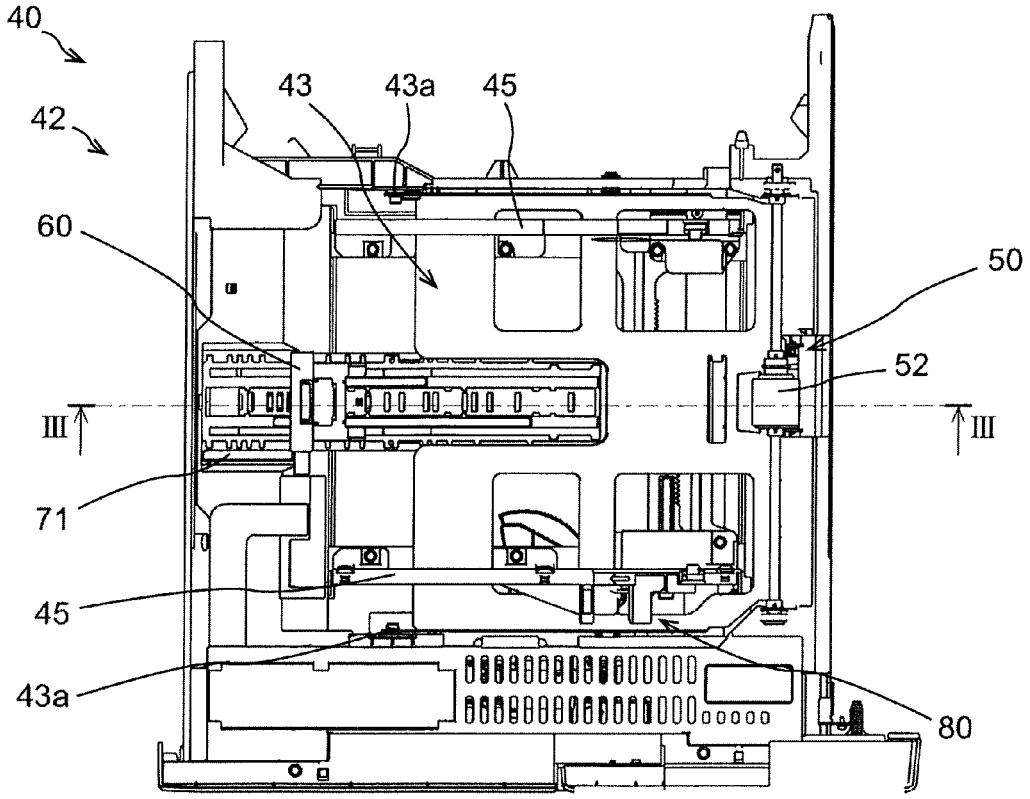
FIG. 2 is a top view of a sheet material feeding device of the image forming apparatus according to the embodiment of the present invention.
Figure 3:
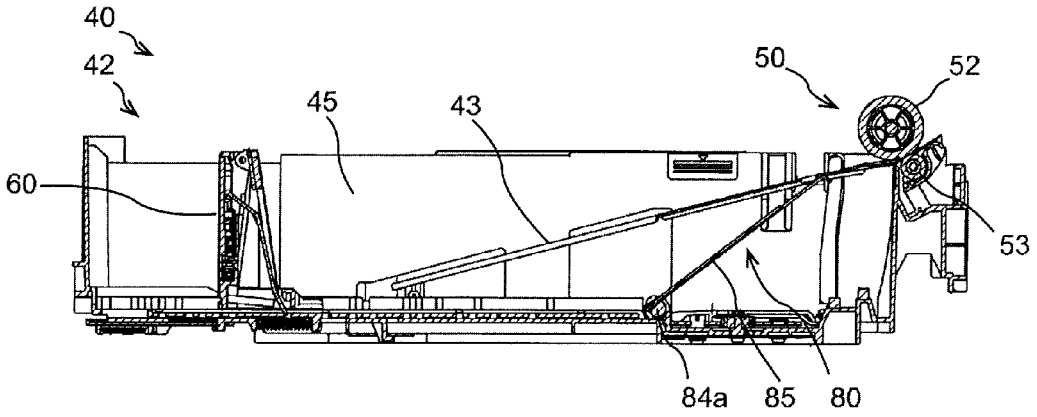
FIG. 3 is a vertical sectional front view of the sheet material feeding device of the image forming apparatus according to the embodiment of the present invention.
Figure 4:
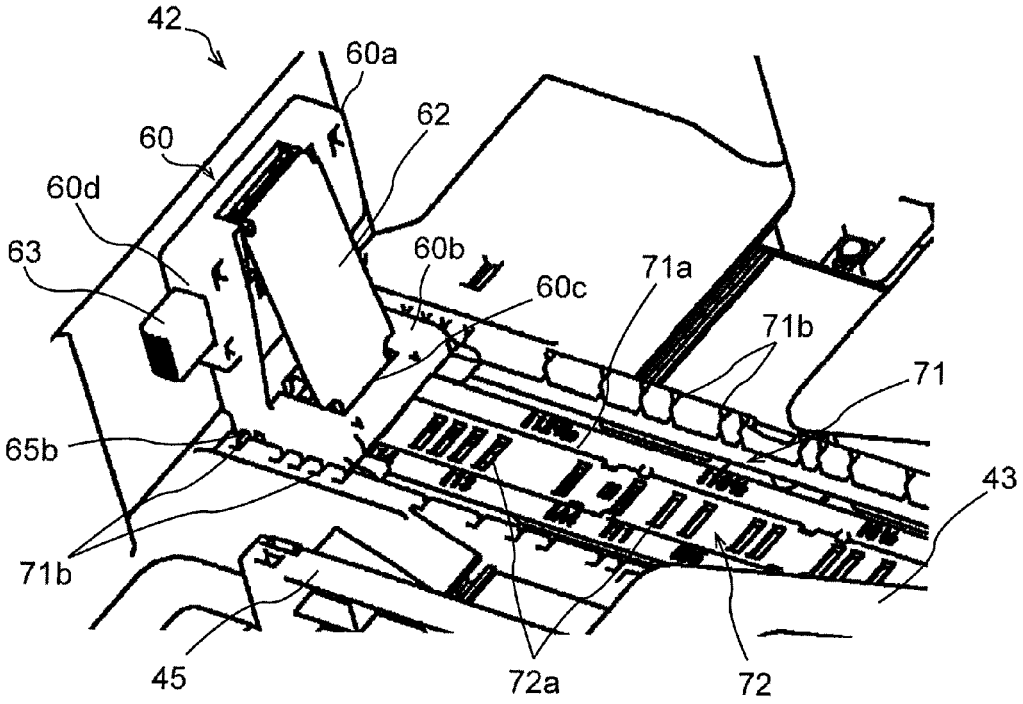
FIG. 4 is a partial magnified perspective view of a cassette of the sheet material feeding device according to the embodiment of the present invention.
Figure 5:
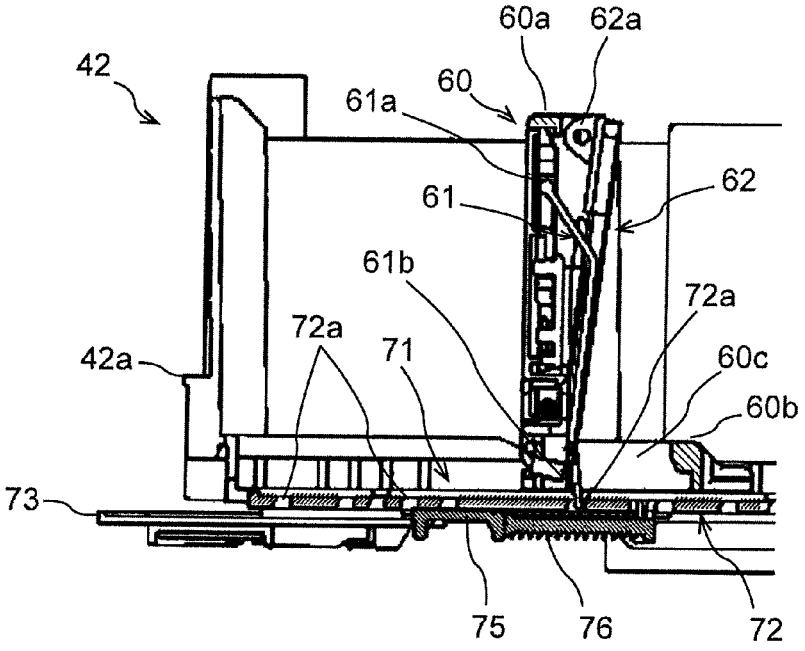
FIG. 5 is a partial magnified vertical sectional front view of the cassette of the sheet material feeding device according to the embodiment of the present invention (when the cassette is pulled out)

Subsequently, description is made of the structure of the sheet material feeding device 40 of the image forming apparatus 1 with reference to FIG. 2 to FIG. 5. FIG. 2 and FIG. 3 are a top view and a vertical sectional front view of the sheet material feeding device 40, respectively. FIG. 4 is a partial magnified perspective view of a cassette of the sheet material feeding device 40. FIG. 5 is a partial magnified vertical sectional front view of the cassette of the sheet material feeding device 40 (when the cassette is pulled out). Note that FIG. 3 corresponds to a vertical sectional view along a line III-III in FIG. 2, and the illustration of the periphery of the rear-end regulating member to be described below is omitted. The lower side of FIG. 2 corresponds to the front surface side of the sheet material feeding device 40 and the upper side of FIG. 2 corresponds to the back surface side of the sheet material feeding device 40. The up-down direction in FIG. 3 coincides with the up-down direction of the sheet material feeding device 40 and the left-right direction in FIG. 3 coincides with the left-right direction of the sheet material feeding device 40.

The sheet material feeding device 40 includes a housing 41 (shown in FIG. 1) and a cassette 42 as illustrated in FIG. 2 and FIG. 3. The cassette 42 is a sheet material housing unit that internally houses the loaded sheet materials such as cut paper before being printed. The cassette 42 has a flat box-like shape with its upper surface open, and will have the sheet materials loaded from the upper surface direction. Note that the sheet materials are sent to the cassette 42 to the rightward direction in FIG. 2 and FIG. 3 by the operation of the feeding unit 50 to be described below.

The cassette 42 can slide horizontally relative to the housing 41 along a guide portion, which is not shown, provided extending in the front-back direction between the cassette 42 and the housing 41. The cassette 42 can be pulled out of or housed in the housing 41 by being pulled out or pushed in the front-back direction.

On an inner bottom surface of the cassette 42, a lift-up plate 43 is disposed. The sheet materials are placed and piled up on the lift-up plate 43. The lift-up plate 43 is supported on the inner bottom surface of the cassette 42 with a shaft 43*a* extending in the front-back direction and provided at an upstream end of the lift-up plate 43 in the sheet material feeding direction, i.e., at the left end in FIG. 2. The lift-up plate 43 can swing around the shaft 43*a* within the vertical surface while having a downstream end (right end) in the sheet material feeding direction as the free end, and the inclination angle in the sheet material feeding direction changes in accordance with the amount of sheet materials loaded on the upper surface. One shaft 43*a* is provided at a front surface side of the lift-up plate 43 and another shaft 43*a* is provided at a back surface side thereof.

A lift-up plate displacing mechanism 80 to be described in detail below is disposed below a downstream part of the lift-up plate 43 in the sheet material feeding direction between the downstream part and the inner bottom surface of the cassette 42 on a front surface side of the lift-up plate 43 and an outer bottom surface of the cassette 42 (see FIG. 14 and FIG. 15). When the cassette 42 is housed in the housing 41, the lift-up plate displacing mechanism 80 operates to raise the downstream part of the lift-up plate 43 in the sheet material feeding direction. When the cassette 42 is pulled out of the housing 41, the lift-up plate displacing mechanism 80 operates so that the lift-up plate 43 falls down on the inner bottom surface of the cassette 42. In this manner, the lift-up plate displacing mechanism 80 changes the posture of the lift-up plate 43.

Above the downstream part of the cassette 42 in the sheet material feeding direction, the housing 41 is provided with the feeding unit 50. The feeding unit 50 sends the sheet material housed in the cassette 42 out of the cassette 42. The feeding unit 50 includes a feeding roller 52 and a handling roller 53 as illustrated in FIG. 3.

The feeding roller 52 is disposed above the downstream part of the lift-up plate 43 in the sheet material feeding direction. The downstream part of the sheet materials in the sheet material feeding direction, which are loaded on the lift-up plate 43, is lifted up by the lift-up plate 43. This lifting causes the uppermost layer of the sheet materials to press the feeding roller 52 from below, so that the sheet material gets in pressure contact with the feeding roller 52. The sheet material S in the cassette 42 is sent out of the cassette 42 by the feeding roller 52.

The feeding roller 52 is provided so that the lower part of the surface of the feeding roller 52 protrudes toward the sheet material transport path Q (shown in FIG. 1) extending from the sheet material feeding device 40 to the outside. The feeding roller 52 is connected to a motor, which is not shown, and is rotated thereby.

The handling roller 53 is disposed below the feeding rollers 52 with the sheet material transport path Q interposed between the rollers 52 and 53. The handling roller 53 presses the feeding roller 52 by the operation of an energizing member, which is not shown, so that the rollers 52 and 53 are in contact with each other. The sheet material is inserted into the nip portion formed by the contact between the handling roller 53 and the feeding roller 52. The handling roller 53 is not connected to the motor but since the handling roller 53 is in contact with the feeding roller 52, the handling roller 53 is rotated as the feeding roller 52 is rotated.

The handling roller 53 has its shaft provided with, for example, a torque limiter (not shown). When the sheet material does not exist in the nip portion formed by the contact between the handling roller 53 and the feeding roller 52 or when just one piece of sheet material has entered the nip portion, the torque more than the set torque of the torque limiter is applied to the handling roller 53. In this case, the handling roller 53 is rotated in a direction of sending out the sheet material in accordance with the feeding roller 52. On the other hand, when a plurality of pieces of sheet materials overlapped on each other has entered the nip portion, the torque less than the set torque of the torque limiter is applied to the handling roller 53. In this case, the handling roller 53 stops rotating. This will not cause the lower one of the overlapped sheet materials to be sent out, thereby preventing the multi-feeding that the sheet materials are sent in the overlapped state.

A side regulating plate 45 is disposed at each of opposite ends in a direction intersecting with the feeding direction of the sheet materials loaded on the lift-up plate 43 inside the cassette 42, i.e., disposed on each of a front surface side and a back surface side of the sheet material. The side regulating plate 45 can move in the direction intersecting with the sheet material feeding direction, and can be brought into contact with the end face of the sheet material bundle on the front surface side and the end face thereof on the back surface side. Thus, the side regulating plate 45 regulates the position in the direction intersecting with the sheet material feeding direction.

A rear-end regulating member 60 is disposed on the upstream side of the feeding direction of the sheet materials loaded on the lift-up plate 43 inside the cassette 42. One rear-end regulating member 60 is provided in a central part in the direction intersecting with the sheet material feeding direction. The rear-end regulating member 60 can move in parallel to the sheet material feeding direction, and can be brought into contact with the end face (rear end) of the bundle of the sheet materials on the upstream side in the feeding direction. Thus, the rear-end regulating member 60 regulates the position of the upstream end in the sheet material feeding direction.

Figure 6:
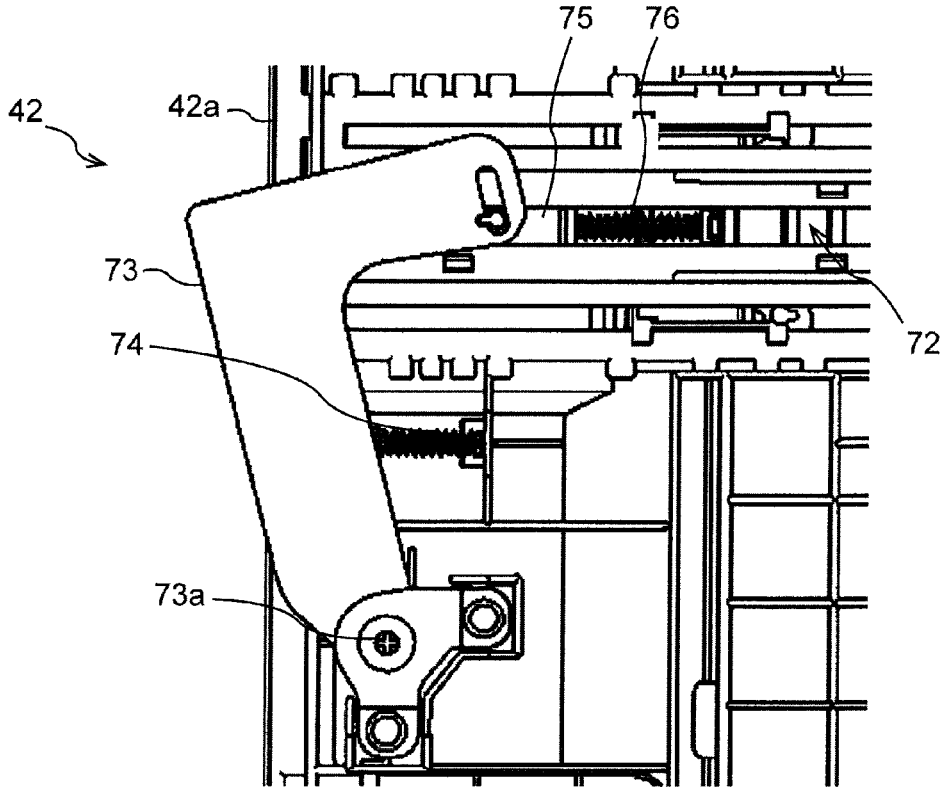
FIG. 6 is a partial magnified bottom view of the cassette of the sheet material feeding device according to the embodiment of the present invention (when the cassette is pulled out)
Figure 7:
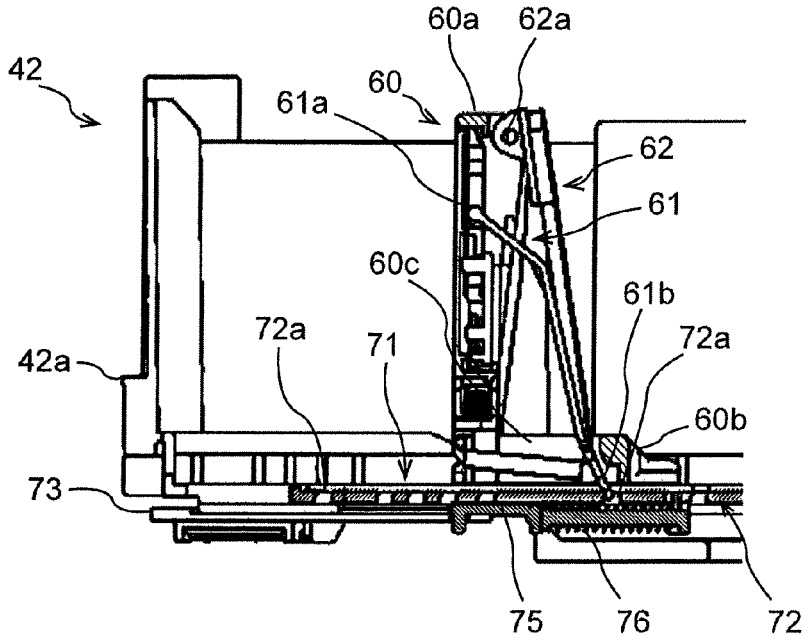
FIG. 7 is a partial magnified vertical sectional front view of the cassette of the sheet material feeding device according to the embodiment of the present invention (when the cassette is housed)
Figure 8:
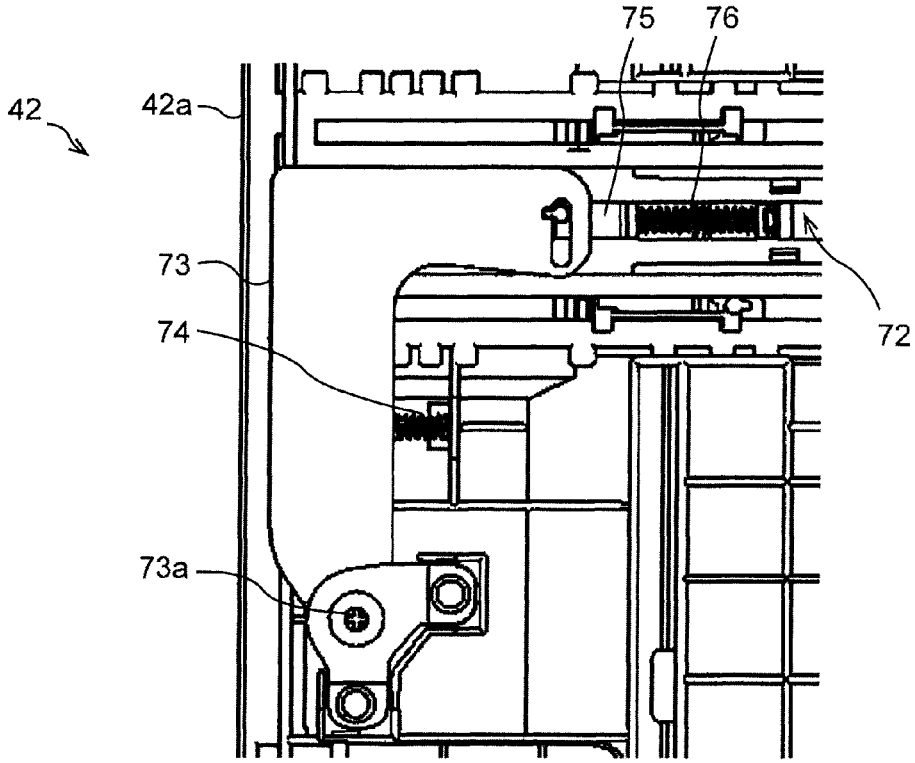
FIG. 8 is a partial magnified bottom view of the cassette of the sheet material feeding device according to the embodiment of the present invention (when the cassette is housed)

Subsequently, description is made of the rear-end regulating member 60 and the peripheral structure with reference to FIG. 6 to FIG. 8 in addition to FIG. 2, FIG. 4, and FIG. 5. FIG. 6 is a partial magnified bottom view of the cassette 42 (when the cassette 42 is pulled out). FIG. 7 and FIG. 8 are a partial magnified vertical sectional front view and a partial magnified bottom view of the cassette 42 (when the cassette 42 is housed), respectively.

The rear-end regulating member 60 has an external shape like a letter of L when viewed from the front, and the rear-end regulating member 60 includes a vertical portion 60*a* and a horizontal portion 60*b* as illustrated in FIG. 4 and FIG. 5. Note that the vertical portion 60*a* and the horizontal portion 60*b* do not have to be strictly vertical and horizontal, respectively.

The vertical portion 60*a* is formed to be approximately vertically upward from the inner bottom surface of the cassette 42. The horizontal portion 60*b* is formed to be approximately horizontal toward the downstream side in the sheet material feeding direction along the inner bottom surface of the cassette 42 from the lower part of the vertical portion 60*a*. The horizontal portion 60*b* is fitted to a guide rail 71 provided for the inner bottom surface of the cassette 42. The guide rail 71 extends in parallel to the sheet material feeding direction. The rear-end regulating member 60 can move in parallel to the sheet material feeding direction through the guide rail 71.

The rear-end regulating member 60 includes a rear-end displacing member 61 and a rear-end contact member 62. Each of the rear-end displacing member 61 and the rear-end contact member 62 has a plate-like shape extending approximately vertically in the direction intersecting with the sheet material feeding direction. The rear-end displacing member 61 and the rear-end contact member 62 are supported by an upper part of the vertical portion 60*a* respectively through shaft parts 61*a* and 62*a* provided at the upper end and extending approximately horizontally in the direction intersecting with the sheet material feeding direction. The rear-end displacing member 61 and the rear-end contact member 62 can rotate around the axis of the shaft parts 61*a* and 62*a*, respectively, and lower parts thereof swing along the sheet material feeding direction. As illustrated in FIG. 5, the shaft part 61*a* of the rear-end displacing member 61 and the shaft part 62*a* of the rear-end contact member 62 are provided at different positions.

A lower end of each of the rear-end displacing member 61 and the rear-end contact member 62 is inserted into an opening 60*c* penetrating in the up-down direction through the inside of the horizontal portion 60*b* in the horizontal direction. The lower end of the rear-end contact member 62 does not protrude downward from the bottom surface of the horizontal portion 60*b* but a lower end 61*b* of the rear-end displacing member 61 protrudes downward from the bottom surface of the horizontal portion 60*b*.

The rear-end contact member 62 is disposed between the rear-end displacing member 61 and the upstream end of the sheet material in the feeding direction, and is in direct contact with the upstream end of the sheet material in the feeding direction. The rear-end contact member 62 is displaced in the sheet material feeding direction as the rear-end displacing member 61 is displaced in the sheet material feeding direction.

An outer bottom part of the cassette 42 is provided with a sliding member 72. The sliding member 72 is disposed at a position corresponding to a central part of the guide rail 71 in the direction intersecting with the sheet material feeding direction. The sliding member 72 has a relatively long and thin plate-like shape along the bottom surface of the cassette 42, and extends in parallel to the direction where the guide rail 71 extends, i.e., the sheet material feeding direction.

The guide rail 71 has an opening groove 71*a* at a bottom. The opening groove 71*a* penetrates the guide rail 71 in the up-down direction and extends in parallel to the sheet material feeding direction. An upper part of the sliding member 72 is fitted to the opening groove 71*a* and an upper surface thereof is exposed to the inside of the cassette 42. The sliding member 72 can slide in parallel to the direction where the opening groove 71*a* extends, i.e., the sheet material feeding direction.

The sliding member 72 has engagement parts 72*a* in a region where the sliding member 72 is fitted to the opening groove 71*a* and the upper surface is exposed to the inside of the cassette 42. The engagement part 72*a* is formed as a long hole with, for example, a rectangular shape, and a plurality of such engagement parts 72*a* in accordance with the size of the sheet material in the feeding direction is disposed along the sheet material feeding direction. As illustrated in FIG. 5 and FIG. 7, the engagement part 72*a* is engaged with the lower end 61*b* of the rear-end displacing member 61 protruding downward from the bottom surface of the horizontal portion 60*b* of the rear-end regulating member 60.

As illustrated in FIG. 5 and FIG. 6, a first lever member 73 is provided below the sliding member 72 at the outer bottom part of the cassette 42. The first lever member 73 has a plate-like shape along the bottom surface of the cassette 42, and the external shape forms approximately a letter of L when viewed from below. The first lever member 73 is supported by the outer bottom surface of the cassette 42 through a shaft part 73*a* provided at one end of the first lever member 73 and extending approximately vertically. The shaft part 73*a* is provided more on the back surface side (lower side in FIG. 6) than the central part of the cassette 42 in the direction intersecting with the sheet material feeding direction, and the first lever member 73 extends from the shaft part 73*a* to the front surface side (upper side in FIG. 6). The first lever member 73 is rotatable around the axis of the shaft part 73*a*.

A first energizing member 74 is provided outside in the radial direction around the axis of the shaft part 73*a*. The first lever member 73 is energized by the first energizing member 74 in a direction of rotating around the axis of the shaft part 73*a*. The first energizing member 74 includes, for example, a compression coil spring, extends in parallel to the sheet material feeding direction, and is disposed between the bottom part of the cassette 42 and the first energizing member 74. Thus, in the case where the cassette 42 is in the state of being pulled out of the housing 41, a part of the first lever member 73 protrudes more to the outside than an outer wall surface 42*a* of the cassette 42 on the upstream side in the sheet material feeding direction as illustrated in FIG. 5 and FIG. 6.

The sliding member 72 is connected to the other end (free end) of the first lever member 73 through a connector piece 75 and a second energizing member 76. The connector piece 75 and the second energizing member 76 are disposed below the sliding member 72, and are disposed movably in parallel to the sheet material feeding direction like the sliding member 72. The second energizing member 76 includes, for example, a compression coil spring, and is disposed between the connector piece 75 and the sliding member 72 so that the axis of the second energizing member 76 extends in parallel to the sheet material feeding direction. Thus, the elastic force of the second energizing member 76 is exerted along the sheet material feeding direction.

When the cassette 42 is housed in the housing 41, the first lever member 73 is brought into contact with an inner wall of the housing 41 and the whole is withdrawn more to the inside than the outer wall surface 42*a* of the cassette 42 on the upstream side in the sheet material feeding direction while the first lever member 73 resists against the energizing force of the first energizing member 74 as illustrated in FIG. 7 and FIG. 8. This causes the first lever member 73 to press the connector piece 75 toward the downstream side in the sheet material feeding direction, and further the connector piece 75 presses the second energizing member 76. With the energizing force, the second energizing member 76 causes the sliding member 72 to slide toward the downstream side in the sheet material feeding direction. The sliding member 72 slides to the downstream side in the sheet material feeding direction to displace the rear-end displacing member 61, whose lower end 61*b* is engaged with the engagement part 72*a*, to the downstream side in the sheet material feeding direction (see FIG. 7).

When the cassette 42 is pulled out of the housing 41, the contact between the first lever member 73 and the inner wall of the housing 41 is canceled. Then, with the energizing force of the first energizing member 74, a part of the first lever member 73 protrudes more to the outside than the outer wall surface 42*a* of the cassette 42 on the upstream side in the sheet material feeding direction as illustrated in FIG. 5 and FIG. 6. This causes the first lever member 73 to pull the connector piece 75 toward the upstream side in the sheet material feeding direction and further the connector piece 75 causes the sliding member 72 to slide toward the upstream side in the sheet material feeding direction. The sliding member 72 slides to the upstream side in the sheet material feeding direction to displace the rear-end displacing member 61, whose lower end 61*b* is engaged with the engagement part 72*a*, toward the upstream side in the sheet material feeding direction (see FIG. 5).

Note that another embodiment may be employed as long as the rear-end displacing member 61 is displaced to the downstream side in the sheet material feeding direction by sliding the sliding member 72 to the downstream side in the sheet material feeding direction as the cassette 42 is housed into the housing 41. That is to say, for example, the first lever member 73, the connector piece 75, and the second energizing member 76 may be omitted and a part of the sliding member 72 may protrude more to the outside than the outer wall surface 42*a* of the cassette 42 on the upstream side in the sheet material feeding direction in the case where the cassette 42 is in the state of being pulled out of the housing 41. In this case, the first energizing member 74 directly energizes the sliding member 72 to the upstream side in the sheet material feeding direction.

With this structure, as the cassette 42 is housed in the housing 41, the sliding member 72 provided for the cassette 42 slides to the downstream side in the sheet material feeding direction to displace the rear-end displacing member 61 to the downstream side in the sheet material feeding direction. The sliding member 72 is energized by the first energizing member 74 to the upstream side in the sheet material feeding direction. Therefore, when the cassette 42 is not housed in the housing 41, i.e., as the cassette 42 is pulled out of the housing 41, the displacement of the rear-end displacing member 61 to the downstream side of the sheet material feeding direction is canceled. As described above, the first energizing member 74 and the sliding member 72 for displacing the rear-end displacing member 61 in the sheet material feeding direction and selecting whether to displace the rear-end displacing member 61 in the sheet material feeding direction can be provided outside the rear-end regulating member 60. That is, the rear-end regulating member 60 can be formed to have a relatively compact size. Therefore, the sheet material feeding device 40 and the image forming apparatus 1 with the reduced size, which enable the stable feeding even if the posture of the sheet material changes as the sheet material is reduced in the cassette 42 along with the feeding, can be provided.

Moreover, since the first lever member 73 is provided, the sliding amount of the sliding member 72 in the sheet material feeding direction can be adjusted freely in accordance with the mode of the cassette 42 and the like. Thus, the amount of displacing the rear-end displacing member 61 in the sheet material feeding direction can be set suitably.

Further, since the second energizing member 76 is provided, the rear-end displacing member 61 can be displaced freely in the sheet material feeding direction by using the elastic force of the second energizing member 76 when the cassette 42 is housed in the housing 41. Thus, the amount of displacing the rear-end displacing member 61 in the sheet material feeding direction can be suitably set in accordance with the amount of sheet materials in the cassette 42.

Note that since the sliding member 72 is disposed on the outer bottom part of the cassette 42, the sliding member 72 occupies smaller area in the cassette 42. Thus, the sheet material feeding device 40 can be further reduced in size.

The rear-end regulating member 60 includes the rear-end contact member 62 in addition to the rear-end displacing member 61 to be displaced by the sliding member 72. The rear-end contact member 62 is in contact with the upstream end of the sheet material in the feeding direction. This prevents the displacement of the sliding member 72 from directly affecting the sheet material, and thus, the position of the sheet material can be stabilized.

Figure 9:
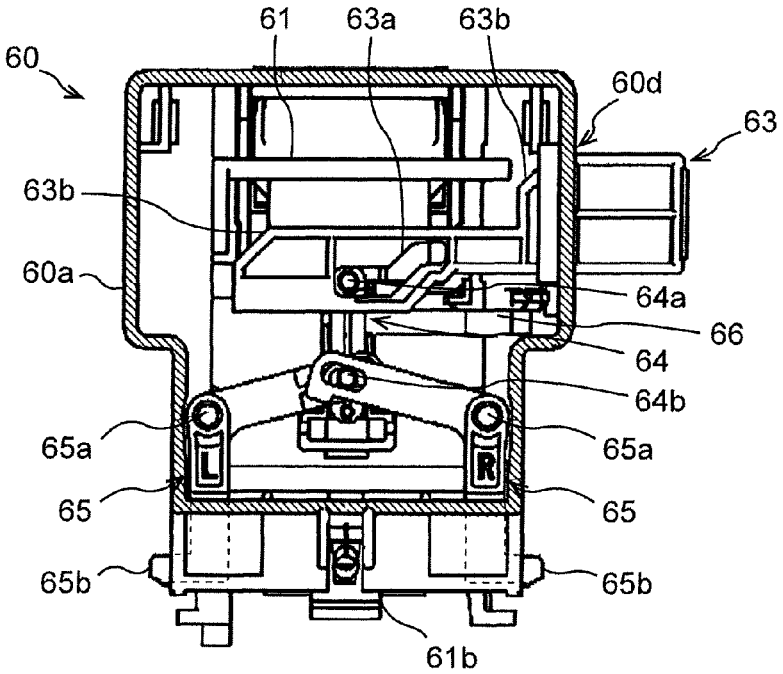
FIG. 9 is a vertical sectional side view of a rear-end regulating member of the sheet material feeding device according to the embodiment of the present invention (when the rear-end regulating member is locked)
Figure 10:
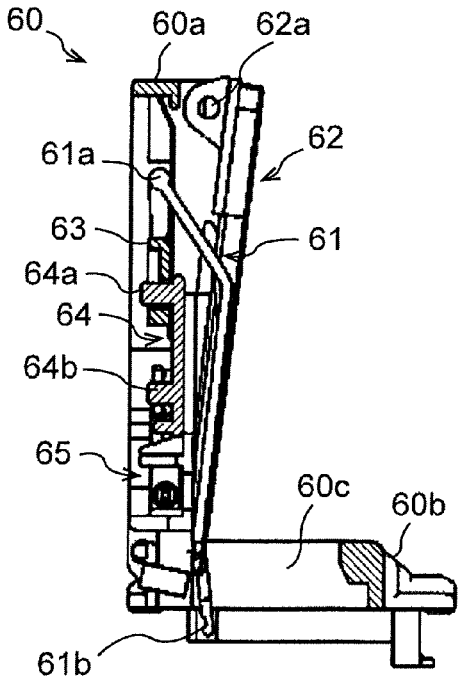
FIG. 10 is a vertical sectional front view of the rear-end regulating member of the sheet material feeding device according to the embodiment of the present invention (when the rear-end regulating member is locked)
Figure 11:
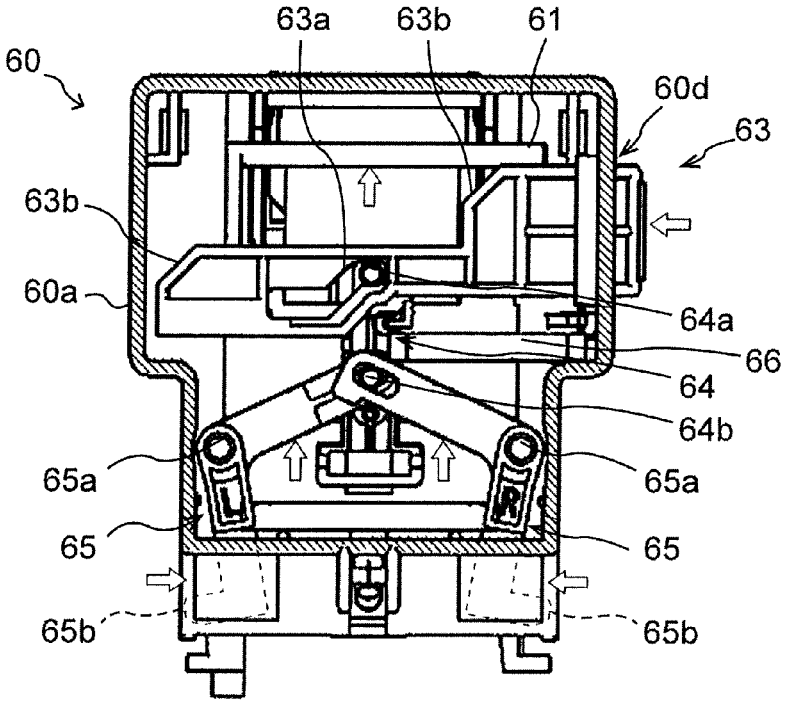
FIG. 11 is a vertical sectional side view of the rear-end regulating member of the sheet material feeding device according to the embodiment of the present invention (when the rear-end regulating member is unlocked)
Figure 12:
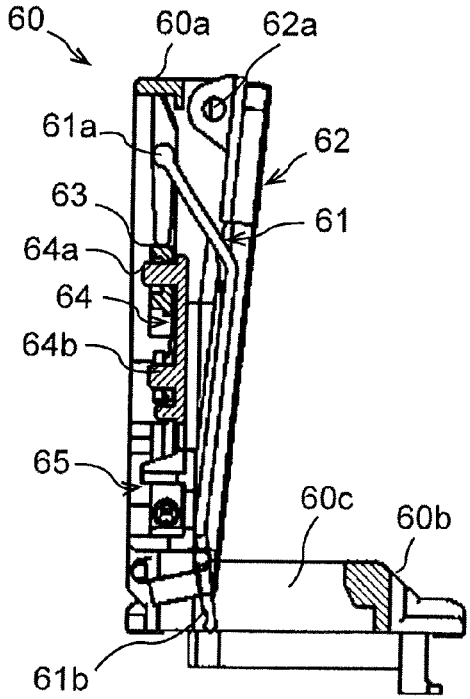
FIG. 12 is a vertical sectional front view of the rear-end regulating member of the sheet material feeding device according to the embodiment of the present invention (when the rear-end regulating member is unlocked)
Figure 13:
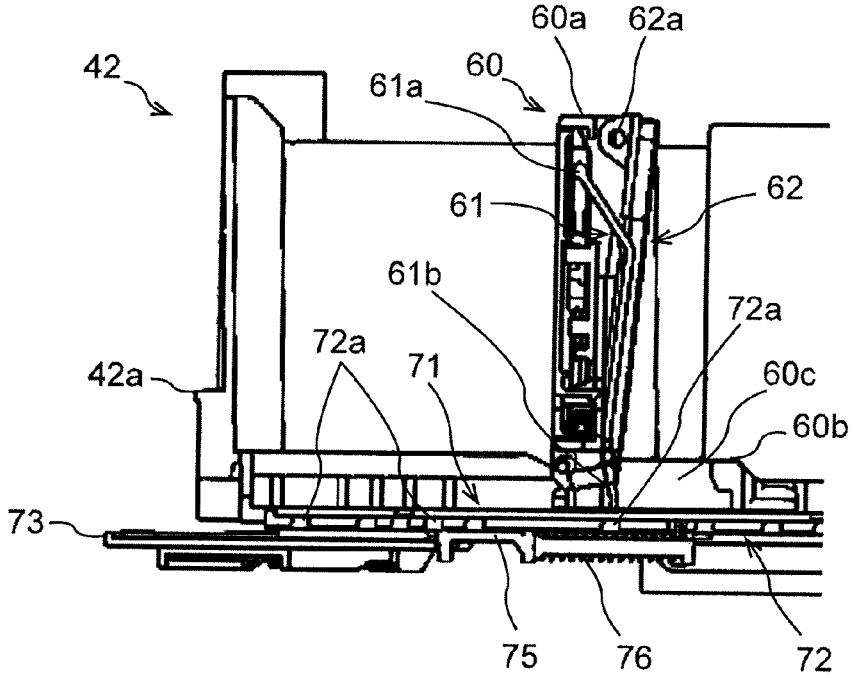
FIG. 13 is a partial magnified vertical sectional front view of the cassette of the sheet material feeding device according to the embodiment of the present invention (when the rear-end regulating member is unlocked)

Subsequently, the detailed structure of the rear-end regulating member 60 is described with reference to FIG. 9 to FIG. 13. FIG. 9 and FIG. 10 are a vertical sectional side view and a vertical sectional front view of the rear-end regulating member 60 (when the rear-end regulating member 60 is locked), respectively. FIG. 11 and FIG. 12 are a vertical sectional side view and a vertical sectional front view of the rear-end regulating member 60 (when the rear-end regulating member 60 is unlocked), respectively. FIG. 13 is a partial magnified vertical sectional front view of the cassette 42 (when the rear-end regulating member 60 is unlocked).

In addition to the rear-end displacing member 61 and the rear-end contact member 62, the rear-end regulating member 60 includes an unlocking lever 63, an up-down movable link 64, and a lock claw 65 as illustrated in FIG. 9 and FIG. 10. The unlocking lever 63, the up-down movable link 64, and the lock claw 65 are provided for the vertical portion 60*a* of the rear-end regulating member 60.

The unlocking lever 63 has a longitudinal shape extending in the direction intersecting with the sheet material feeding direction, and is disposed at the upper part of the vertical portion 60*a* and near the shaft part 61*a* of the rear-end displacing member 61. A part of the unlocking lever 63 on one end side in the direction intersecting with the sheet material feeding direction is exposed to the outside through a window 60*d* provided for a side wall on the front surface side of the vertical portion 60*a*, and the other part of the unlocking lever 63 is incorporated in the rear-end regulating member 60. The unlocking lever 63 is provided for the vertical portion 60*a* so as to be movable in the direction intersecting with the sheet material feeding direction, and is energized to the direction where a part of the unlocking lever 63 is exposed to the outside through the window 60*d* by a lock spring 66.

The up-down movable link 64 has a stick-like shape extending in the up-down direction, and is disposed in the vertical portion 60*a* in an approximately central part in the up-down direction and in an approximately central part in the direction intersecting with the sheet material feeding direction. The up-down movable link 64 includes a cam follower 64*a* at an upper end, and a shaft part 64*b* at a lower end. Each of the cam follower 64*a* and the shaft part 64*b* constitutes a pin-like shape extending along the sheet material feeding direction. The cam follower 64*a* is engaged with a cam part 63*a* provided for the unlocking lever 63. The shaft part 64*b* is connected to two lock claws 65.

The cam part 63*a* of the unlocking lever 63 extends in the direction where the unlocking lever 63 moves, i.e., in the direction intersecting with the sheet material feeding direction and is bent in the up-down direction. Thus, moving the unlocking lever 63 causes the up-down movable link 64, which engages with the cam part 63*a*, to move in the up-down direction through the cam follower 64*a*. In the state that a part of the unlocking lever 63 is exposed to the outside of the vertical portion 60*a*, the up-down movable link 64 is positioned on the lower side of the up-down movable range (see FIG. 9) and pushing the unlocking lever 63 into the vertical portion 60*a* causes the up-down movable link 64 to move upward (see FIG. 11).

The lock claw 65 has a shape like a letter of L when viewed from the sheet material feeding direction and is disposed in the lower part of the inside of the vertical portion 60*a*. Two of the lock claws 65 are disposed side by side in the direction intersecting with the sheet material feeding direction. The two lock claws 65 are disposed so that the inner surfaces of the bending part of the letter L face each other. The two lock claws 65 are both supported by the vertical portion 60*a* through the shaft part 65*a* provided for the bending part of the letter L and extending in the sheet material feeding direction. The lock claw 65 can rotate around the axis of the shaft part 65*a*, and the posture is displaced.

In regard to each of the two lock claws 65, one end on the upper side is connected to the shaft part 64*b* of the up-down movable link 64 and one end on the lower side is provided with a claw part 65*b*. The claw part 65*b* is positioned near the bottom part of the rear-end regulating member 60. Each claw part 65*b* appears with respect to the side walls on both ends of the rear-end regulating member 60 in the direction intersecting with the sheet material feeding direction, i.e., the side walls on the front surface side and the back surface side. The claw part 65*b* protruding from each of the side walls on the front surface side and the back surface side of the rear-end regulating member 60 is engaged with an engagement groove 71*b* provided for the side wall of the guide rail 71 as illustrated in FIG. 4. Like the engagement part 72*a* of the sliding member 72 to be engaged with the lower end 61*b* of the rear-end displacing member 61, a plurality of engagement grooves 71*b* in accordance with the size of the sheet materials in the feeding direction is disposed along the sheet material feeding direction.

While the unlocking lever 63 of the rear-end regulating member 60 is not in operation, a part of the unlocking lever 63 is exposed to the outside through the window 60*d* of the side wall on the front surface side of the rear-end regulating member 60 by the operation of the energizing force of the lock spring 66 as illustrated in FIG. 9 and FIG. 10. The up-down movable link 64 is positioned on the lower side of the up-down movable range by the operation of the cam part 63*a* and the cam follower 64*a*. When the up-down movable link 64 comes to the lower side of the movable range, the two lock claws 65 maintain the posture that their claw parts 65*b* protrude from the side walls on the front surface side and the back surface side of the rear-end regulating member 60. This causes the claw part 65*b* to be engaged with the engagement groove 71*b* of the guide rail 71, thereby locking the rear-end regulating member 60. In this state, the rear-end regulating member 60 cannot be moved along the guide rail 71.

If the unlocking lever 63 of the rear-end regulating member 60 is operated, the unlocking lever 63 is pushed into the vertical portion 60*a* in the direction intersecting with the sheet material feeding direction while resisting the energizing force of the lock spring 66 as illustrated in FIG. 11 and FIG. 12. The up-down movable link 64 moves upward by the operation of the cam part 63*a* and the cam follower 64*a*. The upward movement of the up-down movable link 64 causes the two lock claws 65 to rotate around the axis of the shaft parts 65*a* and change in the posture; thus, the claws 65*b* are housed inside the rear-end regulating member 60. Thus, the claw part 65*b* and the engagement groove 71*b* of the guide rail 71 are disengaged to unlock the rear-end regulating member 60.

On the other hand, the unlocking lever 63 includes two inclined surfaces 63*b* at two upper positions. Moving the unlocking lever 63 so as to be pushed into the vertical portion 60*a* along the direction intersecting with the sheet material feeding direction brings the two inclined surfaces 63*b* into contact with the upper part of the rear-end displacing member 61 from below inside the vertical portion 60*a*. In addition, pushing the unlocking lever 63 into the vertical portion 60*a* causes the upper part of the rear-end displacing member 61 to go over the unlocking lever 63, thereby displacing the rear-end displacing member 61 upward as illustrated in FIG. 11 and FIG. 12. This can disengage the lower end 61*b* of the rear-end displacing member 61 and the engagement part 72*a* of the sliding member 72 from each other as illustrated in FIG. 13.

By operating the unlocking lever 63, the claw part 65*b* and the engagement groove 71*b* of the guide rail 71 are disengaged from each other, and by disengaging the lower end 61*b* of the rear-end displacing member 61 and the engagement part 72*a* of the sliding member 72 from each other, the rear-end regulating member 60 can be moved along the guide rail 71.

In this manner, since the rear-end regulating member 60 includes the unlocking lever 63 corresponding to a selecting member to select whether to engage or disengage the rear-end displacing member 61 relative to the engagement part 72*a* of the sliding member 72, the rear-end regulating member 60 can be moved easily. Therefore, the stable feeding of the sheet material in accordance with the sheet materials with various kinds of sizes and shapes is possible.

Figure 16:
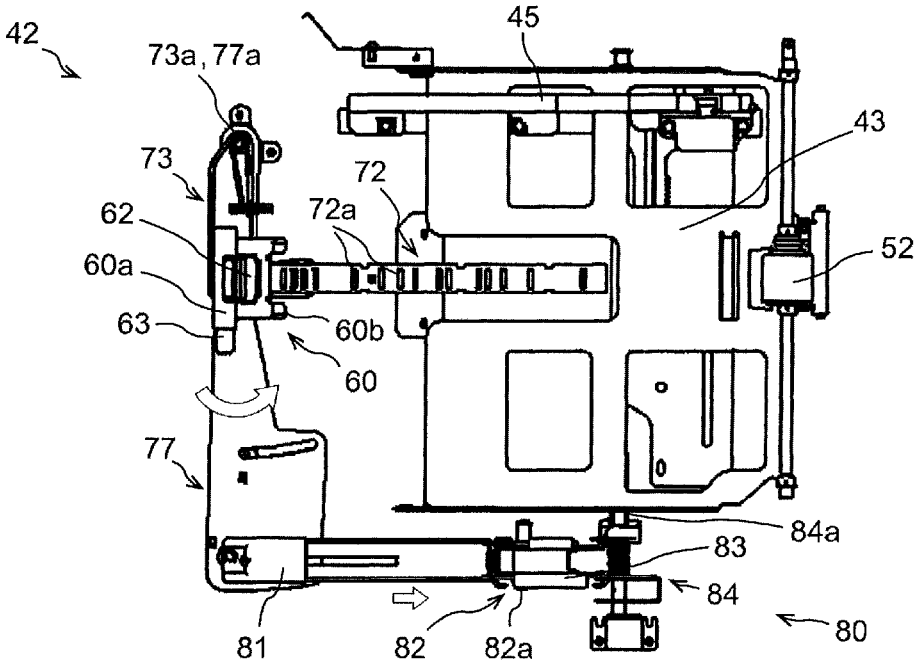
FIG. 16 is a partial plan view of the cassette of the sheet material feeding device according to the embodiment of the present invention (when the cassette is housed)
Figure 17:
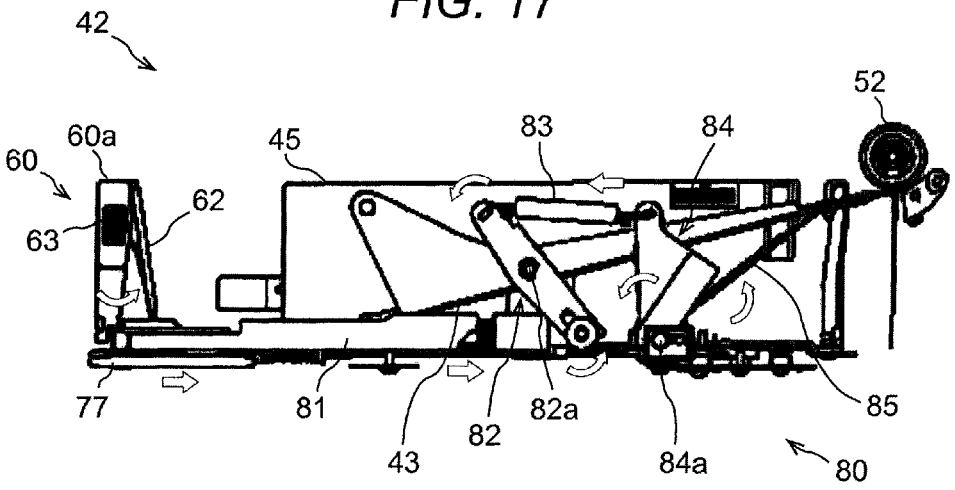
FIG. 17 is a partial front view of the cassette of the sheet material feeding device according to the embodiment of the present invention (when the cassette is housed).

Subsequently, a detailed structure of the lift-up plate displacing mechanism 80 and its periphery will be described with reference to FIG. 14 to FIG. 17. FIG. 14 and FIG. 15 are a partial plan view and a partial front view of the cassette 42 (when the cassette 42 is pulled out). FIG. 16 and FIG. 17 are a partial plan view and a partial front view of the cassette 42 (when the cassette 42 is housed). Note that in FIG. 14 to FIG. 17, the illustration of the cassette 42 with a flat box-like shape whose upper surface is open is omitted.

Figure 14:
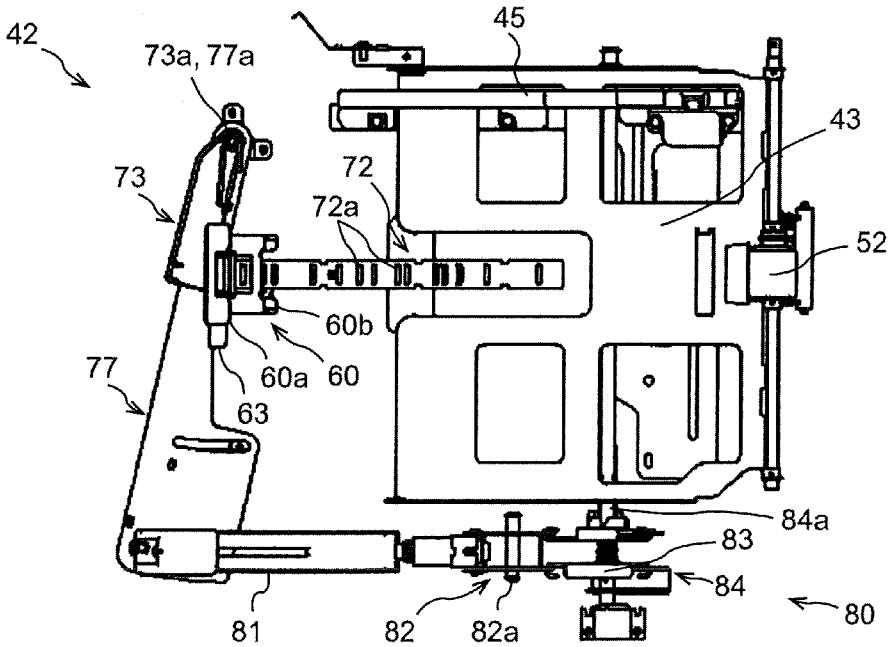
FIG. 14 is a partial plan view of the cassette of the sheet material feeding device according to the embodiment of the present invention (when the cassette is pulled out)
Figure 15:
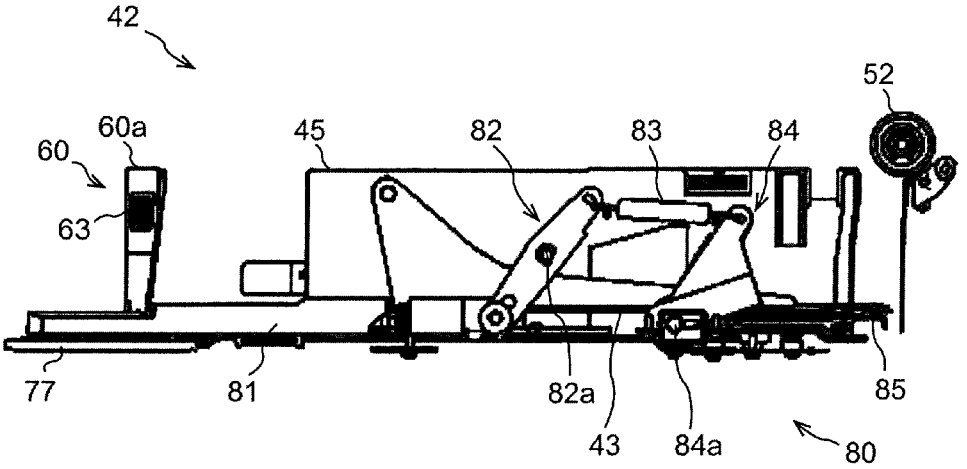
FIG. 15 is a partial front view of the cassette of the sheet material feeding device according to the embodiment of the present invention (when the cassette is pulled out)

The cassette 42 includes the lift-up plate displacing mechanism 80 for changing the posture of the lift-up plate 43 and a second lever member 77 for operating the lift-up plate displacing mechanism 80 as illustrated in FIG. 14 and FIG. 15. The lift-up plate displacing mechanism 80 includes a linearly movable link 81, a first rotatable link 82, a lift-up spring 83, a second rotatable link 84, and a lift-up lever 85.

The second lever member 77 is provided at the outer bottom part of the cassette 42 and below the first lever member 73. The second lever member 77 has a plate-like shape along the bottom surface of the cassette 42, and extends in the direction intersecting with the sheet material feeding direction. The second lever member 77 is supported by the outer bottom surface of the cassette 42 through a shaft part 77*a* provided at one end of the second lever member 77 and extending approximately vertically. The shaft part 77*a* is provided more on the back surface side than the central part of the cassette 42 in the direction intersecting with the sheet material feeding direction, and the second lever member 77 extends from the shaft part 77*a* to the front surface side. The second lever member 77 can rotate around the axis of the shaft part 77*a*.

The linearly movable link 81 is provided at the bottom part of the cassette 42 and more on the front surface side than the central part of the cassette 42 in the direction intersecting with the sheet material feeding direction. The linearly movable link 81 forms a longitudinal shape along the bottom surface of the cassette 42, and extends in parallel to the sheet material feeding direction. The linearly movable link 81 is guided by a guide member, which is not shown, and can move in parallel to the sheet material feeding direction. An upstream end of the linearly movable link 81 in the sheet material feeding direction is connected to the end of the second lever member 77 on the front surface side, and a downstream end of the linearly movable link 81 in the sheet material feeding direction is connected to a lower end of the first rotatable link 82.

The first rotatable link 82 is provided in the region corresponding to the downstream end of the linearly movable link 81 in the sheet material feeding direction and on the front surface side of an approximately upstream side part of the lift-up plate 43 in the sheet material feeding direction. The first rotatable link 82 forms a longitudinal shape extending in an approximately up-down direction. The first rotatable link 82 is supported by the cassette 42 through the shaft part 82*a* provided at an approximately central part in the up-down direction and extending approximately horizontally in the direction intersecting with the sheet material feeding direction. The first rotatable link 82 can rotate clockwise or counterclockwise around the axis of the shaft part 82*a* when viewed from the front (see FIG. 15). The lower end of the first rotatable link 82 is connected to the downstream end of the linearly movable link 81 in the sheet material feeding direction, and the upper end of the first rotatable link 82 is connected to the upstream end of the lift-up spring 83 in the sheet material feeding direction.

The lift-up spring 83 includes, for example, a tension coil spring, and extends from the region corresponding to the upper end of the first rotatable link 82 to the downstream side in the sheet material feeding direction. The upstream end of the lift-up spring 83 in the sheet material feeding direction is connected to the upper end of the first rotatable link 82, and the downstream end of the lift-up spring 83 in the sheet material feeding direction is connected to the upper end of the second rotatable link 84. The lift-up spring 83 exerts the elastic force by the pulling between the upper end of the first rotatable link 82 and the upper end of the second rotatable link 84.

The lift-up spring 83 is energized through the first rotatable link 82 and the linearly movable link 81 in a direction where the second lever member 77 is rotated around the axis of the shaft part 77*a*. Thus, when the cassette 42 is pulled out of the housing 41, a part of the second lever member 77 protrudes more to the outside than the outer wall surface 42*a* (not shown in FIG. 14 to FIG. 17) of the cassette 42 on the upstream side in the sheet material feeding direction.

The second rotatable link 84 is provided in the region corresponding to the downstream end of the lift-up spring 83 in the sheet material feeding direction and on the front surface side of the approximately central part of the lift-up plate 43 in the sheet material feeding direction. The second rotatable link 84 forms a longitudinal shape extending in an approximately up-down direction. The second rotatable link 84 is supported by the cassette 42 through a shaft part 84*a* provided at the lower end of the second rotatable link 84 and extending approximately horizontally in the direction intersecting with the sheet material feeding direction. The second rotatable link 84 can rotate clockwise or counterclockwise around the axis of the shaft part 84*a* when viewed from the front (see FIG. 15). The upper end of the second rotatable link 84 corresponding to the free end is connected to the downstream end of the lift-up spring 83 in the sheet material feeding direction.

Note that the shaft part 84*a* of the second rotatable link 84 extends relatively long from the front surface side to the back surface side of the lift-up plate 43 in the direction intersecting with the sheet material feeding direction as illustrated in FIG. 14.

The lift-up lever 85 is provided below the downstream part of the lift-up plate 43 in the sheet material feeding direction and in the central part of the lift-up plate 43 in the direction intersecting with the sheet material feeding direction. An upper surface of the lift-up lever 85 has a plate-like shape approximately opposite to a lower surface of the lift-up plate 43, and one side of the lift-up lever 85 that is on the upstream end in the sheet material feeding direction and extends in the direction intersecting with the sheet material feeding direction is attached to the shaft part 84*a* of the second rotatable link 84. The lift-up lever 85 extends outward in the radial direction of the shaft part 84*a* and to the downstream side in the sheet material feeding direction. A downstream end of the lift-up lever 85 in the sheet material feeding direction is in contact with the lower surface of the lift-up plate 43.

When the cassette 42 is housed in the housing 41, the second lever member 77 is in contact with the inner wall of the housing 41 and the entire second lever member 77 retracts more to the inside than the outer wall surface 42*a* of the cassette 42 on the upstream side in the sheet material feeding direction as illustrated in FIG. 16 and FIG. 17. This causes the second lever member 77 to press the linearly movable link 81 toward the downstream side in the sheet material feeding direction, and further the linearly movable link 81 rotates the first rotatable link 82 counterclockwise when viewed from the front. Then, the lift-up spring 83 rotates the second rotatable link 84 with its energizing force counterclockwise when viewed from the front. As the second rotatable link 84 is rotated, the shaft part 84*a* is also rotated counterclockwise when viewed from the front. Thus, the lift-up lever 85 lifts up the downstream part of the lift-up plate 43 in the sheet material feeding direction from below the lift-up plate 43. Therefore, the uppermost layer of the sheet materials loaded on the upper surface of the lift-up plate 43 reaches a predetermined feeding position at which the layer is in contact with the peripheral surface of the feeding roller 52.

When the cassette 42 is pulled out of the housing 41, the contact between the second lever member 77 and the inner wall of the housing 41 is canceled, and as illustrated in FIG. 14 and FIG. 15, a part of the second lever member 77 protrudes more to the outside than the outer wall surface 42*a* of the cassette 42 on the upstream side in the sheet material feeding direction with the energizing force of the lift-up spring 83. This causes the second lever member 77 to pull the linearly movable link 81 toward the upstream side in the sheet material feeding direction, and the linearly movable link 81 rotates the first rotatable link 82 clockwise when viewed from the front. The second rotatable link 84 is also rotated through the lift-up spring 83 clockwise when viewed from the front. As the lift-up lever 85 falls down on the inner bottom surface of the cassette 42, the lift-up plate 43 also falls down on the inner bottom surface of the cassette 42.

In this manner, as the cassette 42 is housed in the housing 41, the second lever member 77 is brought into contact with the housing 41 to make the lift-up plate displacing mechanism 80 operate to change the posture of the lift-up plate displacing mechanism 80 so that the lift-up plate 43 is lifted up. Thus, the uppermost layer of the sheet materials can be moved automatically to a predetermined feeding position.

Moreover, the axis of the shaft part 77*a* of the second lever member 77 coincides with the axis of the shaft part 73*a* of the first lever member 73. As illustrated in FIG. 14, the shaft part 77*a* and the shaft part 73*a* are provided more on the back surface side than the central part of the cassette 42 in the direction intersecting with the sheet material feeding direction, and the second lever member 77 and the first lever member 73 extend from the shaft part to the front surface side. In regard to the length in the direction intersecting with the sheet material feeding direction, the second lever member 77 is longer than the first lever member 73. Thus, when the cassette 42 is housed in the housing 41, the rotation displacement of the first lever member 73 is completed before that of the second lever member 77. That is, before the lifting of the lift-up plate 43 is completed, the sliding member 72 displaces the rear-end displacing member 61 to the downstream side in the sheet material feeding direction.

Therefore, the rear-end displacing member 61 is displaced toward the downstream side in the sheet material feeding direction before the uppermost layer of the sheet materials loaded on the upper surface of the lift-up plate 43 is brought into contact with the peripheral surface of the feeding roller 52. That is, the uppermost layer of the sheet materials reaches the predetermined feeding position after the position of the upstream end (rear end) in the sheet material feeding direction is regulated suitably. As a result, more stable feeding of the sheet materials becomes possible.

Note that the first lever member 73 and the second lever member 77 may be formed as the same member. However, when the first lever member 73 and the second lever member 77 are formed as separate members as described in this embodiment, it is easy to control each of the timing when the uppermost layer of the sheet materials is brought into contact with the peripheral surface of the feeding roller 52 and the timing when the rear-end displacing member 61 is displaced toward the downstream side in the sheet material feeding direction, and the timings can be set suitably.

The embodiment of the present invention has been described so far; however, the present invention is not limited thereto and various changes can be made within the scope not departing from the content of the present invention. Moreover, a plurality of embodiments can be carried out in combination.

For example, the image forming apparatus 1 according to the aforementioned embodiment is a so-called tandem type image forming apparatus for color printing which forms an image by sequentially overlapping images in a plurality of colors using the intermediate transfer belt 11; however, the present invention is not limited to this type of apparatus and is also applicable to an image forming apparatus for color printing that is not a tandem type, or to an image forming apparatus for monochromatic printing.

The present invention is applicable to an image forming apparatus such as a copier.

Although embodiments of the present invention has been described and illustrated in detail, it is clearly understood that the same is by way of illustrated and example only and is not to be taken by way of limitation, the scope of the present invention is interpreted by terms of the appended claims.

What is claimed is:

1. A sheet material feeding device comprising:

a housing;

a cassette configured to internally house a sheet material, and capable of being pulled out of the housing and housed into the housing;

a rear-end regulating member provided inside the cassette and configured to regulate a position of an upstream end of the sheet material in a sheet material feeding direction;

a rear-end displacing member supported by the rear-end regulating member and configured to swing along the sheet material feeding direction;

a sliding member provided for the cassette, having an engagement part to be engaged with the rear-end displacing member, and configured to slide toward a downstream side in the sheet material feeding direction to displace the rear-end displacing member toward the downstream side in the sheet material feeding direction as the cassette is housed in the housing;

a first energizing member configured to energize the sliding member toward an upstream side in the sheet material feeding direction;

a first lever member connected to the sliding member and configured to be brought into contact with the housing to cause the sliding member to slide toward the downstream side in the sheet material feeding direction as the cassette is housed in the housing; and a second energizing member provided between the sliding member and the first lever member and configured to exert an elastic force in the sheet material feeding direction.

2. The sheet material feeding device according to claim 1, wherein the sliding member is disposed at an outer bottom part of the cassette.

3. The sheet material feeding device according to claim 1, further comprising:

a lift-up plate which is disposed on an inner bottom surface of the cassette and on which the sheet material is placed;

a lift-up plate displacing mechanism configured to change a posture of the lift-up plate; and a second lever member that is connected to the lift-up plate displacing mechanism and as the cassette is housed into the housing, is brought into contact with the housing and causes the lift-up plate displacing mechanism to operate to change a posture so as to lift up the lift-up plate.

4. The sheet material feeding device according to claim 3, wherein before the lifting of the lift-up plate is completed, the sliding member displaces the rear-end displacing member toward the downstream side in the sheet material feeding direction.

5. The sheet material feeding device according to claim 1, further comprising a rear-end contact member that is disposed between the rear-end displacing member and an upstream end of the sheet material in the sheet material feeding direction and that is displaced in the sheet material feeding direction as the rear-end displacing member is displaced in the sheet material feeding direction.

6. The sheet material feeding device according to claim 1, wherein the engagement part of the sliding member is one of a plurality of engagement parts to be engaged with the rear-end displacing member, the engagement parts being arranged side by side in the sheet material feeding direction, and the rear-end regulating member includes a selecting member that selects whether to engage or disengage the rear-end displacing member relative to the engagement part.

7. An image forming apparatus comprising the sheet material feeding device according to claim 1.

8. The image forming apparatus according to claim 7, further comprising an image forming unit configured to form an image on a sheet material supplied from the sheet material feeding device.

9. A sheet material feeding device , a housing:

a cassette configured to internally house a sheet material, and capable of being pulled out of the housing and housed into the housing;

a rear-end regulating member provided inside the cassette and configured to regulate a position of an upstream end of the sheet material in a sheet material feeding direction;

a rear-end displacing member supported by the rear-end regulating member and configured to swing along the sheet material feeding direction;

a sliding member provided for the cassette, having an engagement part to be engaged with the rear-end displacing member, and configured to slide toward a downstream side in the sheet material feeding direction to displace the rear-end displacing member toward the downstream side in the sheet material feeding direction as the cassette is housed in the housing; and a first energizing member configured to energize the sliding member toward an upstream side in the sheet material feeding direction; wherein:

the engagement part of the sliding member is one of a plurality of engagement parts to be engaged with the rear-end displacing member, the engagement parts being arranged side by side in the sheet material feeding direction, and the rear-end regulating member includes a selecting member that selects whether to engage or disengage the rear-end displacing member relative to the engagement part.

10. A sheet material feeding device comprising:

a housing;

a cassette configured to internally house a sheet material, and capable of being pulled out of the housing and housed into the housing;

a rear-end regulating member provided inside the cassette and configured to regulate a position of an upstream end of the sheet material in a sheet material feeding direction;

a rear-end displacing member supported by the rear-end regulating member and configured to swing along the sheet material feeding direction;

a sliding member disposed at an outer bottom part of the cassette, having an engagement part to be engaged with the rear-end displacing member, and configured to slide toward a downstream side in the sheet material feeding direction to displace the rear-end displacing member toward the downstream side in the sheet material feeding direction as the cassette is housed in the housing;

a first energizing member configured to energize the sliding member to an upstream side in the sheet material feeding direction;

a first lever member connected to the sliding member and configured to be brought into contact with the housing to cause the sliding member to slide toward the downstream side in the sheet material feeding direction as the cassette is housed in the housing; and a second energizing member provided between the sliding member and the first lever member and configured to exert an elastic force in the sheet material feeding direction.

11. The sheet material feeding device according to claim 10, wherein the engagement part of the sliding member is one of a plurality of engagement parts to be engaged with the rear-end displacing member, the engagement parts being arranged side by side in the sheet material feeding direction, and the rear-end regulating member includes a selecting member that selects whether to engage or disengage the rear-end displacing member relative to the engagement part.

12. The sheet material feeding device according to claim 10, further comprising:

a lift-up plate which is disposed at an inner bottom surface of the cassette and on which the sheet material is loaded;

a lift-up plate displacing mechanism configured to change a posture of the lift-up plate; and a second lever member that is connected to the lift-up plate displacing mechanism and as the cassette is housed into the housing, is brought into contact with the housing and causes the lift-up plate displacing mechanism to operate to change a posture so as to lift up the lift-up plate.

13. The sheet material feeding device according to claim 12, wherein before the lifting of the lift-up plate is completed, the sliding member displaces the rear-end displacing member toward the downstream side in the sheet material feeding direction.

14. The sheet material feeding device according to claim 10, further comprising a rear-end contact member that is disposed between the rear-end displacing member and an upstream end of the sheet material in the sheet material feeding direction and that is displaced in the sheet material feeding direction as the rear-end displacing member is displaced in the sheet material feeding direction.

* * * * *